United States Patent [19]

Close

[11] 4,173,170

[45] Nov. 6, 1979

[54] POLICE FIREARM

[76] Inventor: Ross A. Close, 3831 Glenbrook Rd., Fairfax, Va. 22031

[21] Appl. No.: 867,931

[22] Filed: Jan. 16, 1978

[51] Int. Cl.[2] ..... F41D 5/10

[52] U.S. Cl. ..... 89/188; 89/191 A

[58] Field of Search ..... 89/188, 191 A

[56] References Cited

U.S. PATENT DOCUMENTS 2,211,405 8/1940 Browning ..... 89/191 A

FOREIGN PATENT DOCUMENTS 317095 4/1934 Italy ..... 89/188

*Primary Examiner*—Stephen C. Bentley

[57] ABSTRACT

This invention relates to firearms of the type disclosed in my prior U.S. Pat. No. 3,198,077, granted Aug. 3, 1965, in which the bolt does not turn and the action is locked by turning the receiver. The principal parts, such as floating ring receiver piston and ring power cylinder are made from cylindrical extruded metal tubing or metal rods. The combination of floating ring receiver piston, ring power cylinder and other incidental parts are used to form a new action for an automatic firearm.

This new action consists of a floating ring receiver piston, barrel and ring power cylinder. The above-mentioned parts, the frame and breech block lend themselves to manufacture by the use of automatic lathe and screw machines.

1 Claim, 3 Drawing Figures

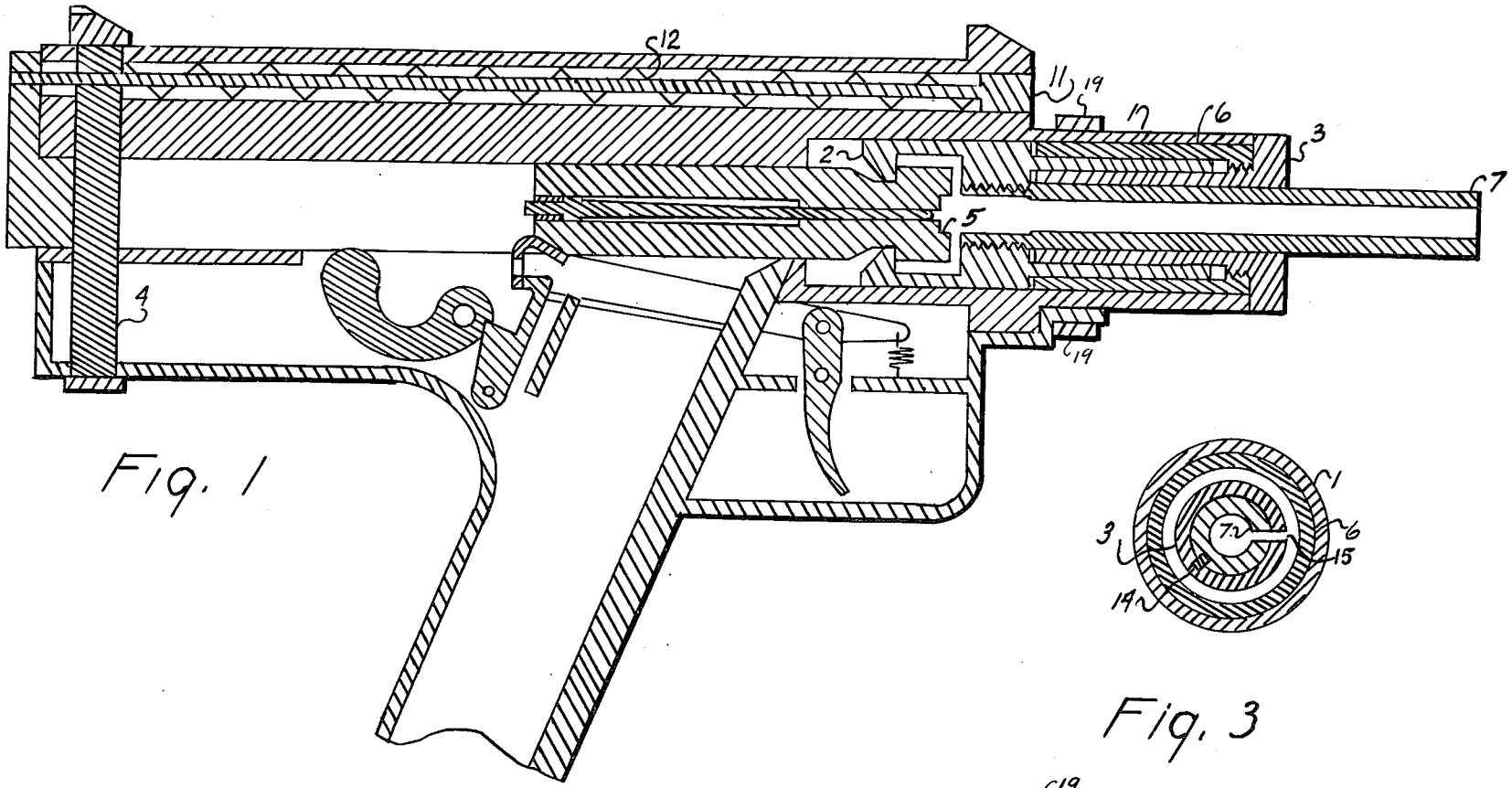
Fig. 1
Fig. 3
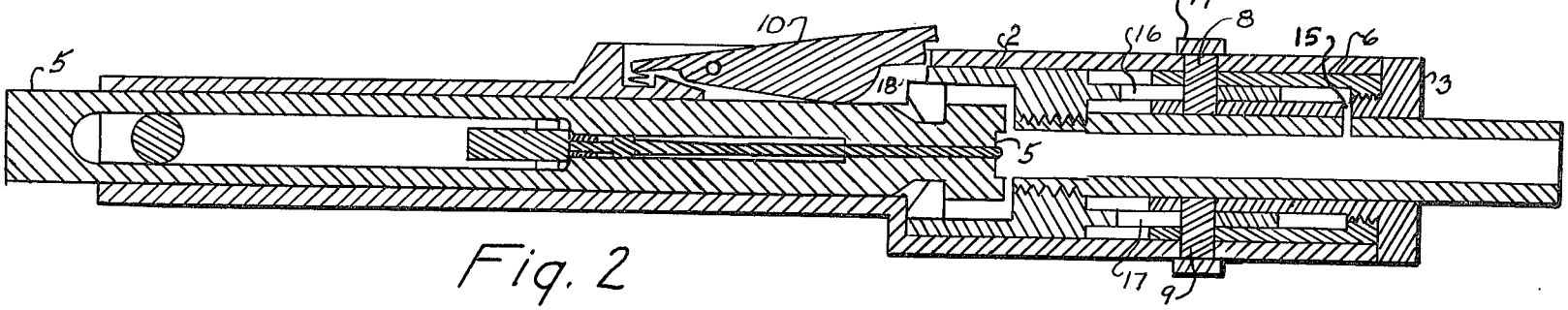
Fig. 2

POLICE FIREARM

DESCRIPTION OF DRAWINGS

FIG. 1 of the drawings shows a partial longitudinal section through the firearm as it might be used in the manufacture of a pistol. This section shows the location of the various parts at time of fire with the action closed.

FIG. 2 is a longitudinal section showing the action partially opened after firing, before the bolt has started to leave the floating ring receiver piston.

FIG. 3 is a cross section through the ring power cylinder at point where gas is fed from the barrel through a hole in the barrel and ring power cylinder to the floating ring receiver piston.

DETAILED SPECIFICATIONS

This action consists of two new parts as follows:
Floating ring receiver piston,
Ring power cylinder.

The floating ring receiver piston 2 shall be made from high strength steel rod internally threaded to fit the barrel 7 and turned to fit as a ring piston between the two parts 3 and 6 of the ring power cylinder. Two cams 16 and 17 shall be cut in the floating ring receiver piston to fit pins 8 and 9. The end of the floating ring receiver piston toward the bolt shall be shaped to fit three or more locking lugs on the bolt.

The ring power cylinder shall be made from high strength steel tubing in two parts 3 and 6 threadedly connected. Holes shall be bored for pins 8 and 9 and for gas port 15.

The bolt 5 shall be of non-turning type, the receiver end shall be fitted with locking lugs to fit the floating ring receiver piston and slotted to fit pin 4. The bolt 5 shall be provided with a connection to the retractor 11 and fitted with a conventional firing pin.

The frame consists of two parts connected by bolt 4 and ring 19. One-half shall be made from metal tubing cut to fit the floating ring receiver piston 2, ring power cylinder bolts 3 and 6, bolt 5, dog 10, retractor 11, conventional extractor and exit port. The other half is to be made from metal plate formed to hold the magazine, trigger, linkage, hammer, etc. of conventional design.

The barrel 7 is externally threaded to fit the floating ring receiver piston 2, turned to fit the ring power cylinder 3. A spline 14 and bore port 15 are cut in the barrel to fit key and bore port in ring power cylinder 3.

The operation of the action is as follows:

At instant of fire the floating ring receiver piston 2 is held in a position by the cam 16 and 17 engaging pins 8 and 9 so that its lugs are engaged with the lugs of bolt 5 and locks 5 and 2 together to support fired shell. When the bullet passing down the barrel reaches a point beyond gas port 15, high pressure gas passes through port 15 into the chamber between parts 3 and 6 of the ring power cylinder and pushes the floating ring receiver piston 2, the barrel 7 and bolt 5 toward pin 4. The floating ring receiver piston is simultaneously turned on the barrel 7 threads by cams 16 and 17 engaging pins 8 and 9; barrel is prevented from rotating by spline 14 and at point shown in FIG. 2 the lugs in the breech block 5 coincide with the slots between the lugs on the floating ring receiver piston 2 and the bolt 5 is carried by momentum to move back, cocking the hammer, throwing out the spent shell, and causing retractor 11 to compress spring 12. The compressed spring 12 through the retractor 11 pulls the bolt 5 toward the floating ring receiver piston which is being held from rotating by dog 10 engaging slot 18, feeding in a shell into the barrel, lifting dog 10 so that floating ring receiver piston can be rotated by the cams 16 and 12 engaging pins 8 and 9 back to the locked position as shown in FIG. 1, thus completing the cycle.

I claim:

1. A firearm comprising in combination a frame having a longitudinally movable floating ring receiver piston combined threadedly with a barrel contained within the two parts of a ring power cylinder turned to release a concentric bolt by cams cut in the piston part of the floating ring receiver piston actuated to turn the floating ring receiver piston by pins through the frame, float-ring receiver piston and ring power piston to release locking lugs between bolt and floating ring receiver piston actuated by gas pressure from a port in the barrel and ring power cylinder, feeding high pressure gas to chamber formed by floating ring receiver piston and ring power cylinder.

* * * * *